US005676084A

United States Patent [19]

Palmer et al.

[11] Patent Number: 5,676,084

[45] Date of Patent: Oct. 14, 1997

[54] RETRIEVABLE MOORING DEVICE

[76] Inventors: Buren T. Palmer, P.O. Box 1029; Buren T. Palmer, II, 12,857 Elaine Dr., both of Walker, La. 70785

[21] Appl. No.: 629,352

[22] Filed: Apr. 8, 1996

[51] Int. Cl.[6] ..... B63B 21/00

[52] U.S. Cl. ..... 114/230; 294/82.31

[58] Field of Search ..... 114/221 R, 230, 114/297, 294, 215; 294/82.24, 82.31

[56] References Cited

U.S. PATENT DOCUMENTS

| | | | |
|---|---|---|---|
| 1,509,012 | 9/1924 | Whiting | 114/215 |
| 3,353,817 | 11/1967 | Bollinger | 114/215 |
| 4,751,892 | 6/1988 | Sechel | 294/19.1 |
| 4,785,509 | 11/1988 | Fisher | 114/230 |
| 5,083,522 | 1/1992 | Ashrow | 114/215 |
| 5,116,260 | 5/1992 | Upchurch | 114/230 |
| 5,415,450 | 5/1995 | Faxon | 294/82.31 |

*Primary Examiner*—Sherman Basinger

*Attorney, Agent, or Firm*—Reginald F. Roberts, Jr.

[57] ABSTRACT

A retrievable boat mooring device for reversible attachment to an off-shore oil platform. The mooring device includes a modified U-shaped hook, one end of which is attached to a cable. A tubular Nylon rope is attached to the other end of the hook, and the cable and the rope are attached to one another. The free end of the cable terminates in a loop for grasping and pulling the cable. The mooring device is secured to the platform by casting the hook over a stationary elongated horizontal support, and is retrieved by pulling on the cable loop, thereby drawing the hook over and away from the stationary horizontal support. The advantage of the present invention over the present state of the art is that it enables one to tie a boat to and untie a boat from an off-shore oil platform without having to come dangerously near the platform.

4 Claims, 2 Drawing Sheets

RETRIEVABLE MOORING DEVICE

BACKGROUND OF THE INVENTION

The present invention relates to marine mooring devices. More particularly, the invention relates to a retrievable mooring device for tying to and untying a boat from an off-shore oil platform or similar structure.

In the present state of the art boats are tied to and untied from such structures by the use of a "shepherd's staff" type hook. The shepherd's hook is approximately seven feet in length, and is made of metal. It is therefore necessary for a person to approach within about seven feet of the oil platform in order to secure it thereto, since because of its size, shape, and weight, the hook cannot be thrown. Manually attaching the hook to the platform puts oneself and one's boat in danger. Accordingly, a need exists for a different type of mooring device, with which such a dangerously close approach is unnecessary. The present invention meets this need.

SUMMARY OF THE INVENTION

In general, the present invention in a first aspect provides a retrievable hook for reversibly securing a boat to an off-shore oil platform. The retrievable hook comprises a rigid member which includes a first straight segment, a second straight segment parallel to the first straight segment, and a curved segment disposed between and connecting the first and second straight segments to one another.

In a second aspect the invention provides a retrievable boat mooring device for reversible attachment to a stationary elongated rigid horizontal member on an off-shore oil platform. The retrievable boat mooring device comprises a rigid member which includes a first straight segment having first and second ends, a second straight segment having first and second ends, and a curved segment disposed between and connecting the first and second straight segments to one another. The first and second straight segments are parallel to one another. The first end of the first straight segment is free, and the second end of the first straight segment is connected to a first end of the curved segment. The first end of the second straight segment is free, and the second end of the second straight segment is connected to a second end of the curved segment.

The retrievable boat mooring device further comprises a first elongated flexible member having first and second ends, a second elongated flexible member having first and second ends, means for attaching the hook to the first end of the first elongated flexible member, and means for attaching the hook to the first end of the second elongated flexible member.

The retrievable boat mooring device is secured to the stationary horizontal member on the off-shore oil platform by casting the hook from the boat over the horizontal member, and is retrieved therefrom by pulling on the second end of the second elongated flexible member, thereby drawing the hook over and away from the stationary horizontal member.

In a third aspect the invention provides a method for reversibly securing a boat to a stationary elongated rigid horizontal member on an off-shore oil platform. The method comprises providing a retrievable boat mooring device which comprises a rigid member including a first straight segment having first and second ends, a second straight segment having first and second ends, and a curved segment disposed between and connecting the first and second straight segments to one another. The first and second straight segments are parallel to one another. The first end of the first straight segment is free, and the second end of the first straight segment is connected to a first end of the curved segment. The first end of the second straight segment is free, and the second end of the second straight segment is connected to a second end of the curved segment.

The retrievable boat mooring device further comprises a first elongated flexible member having first and second ends, a second elongated flexible member having first and second ends, means for attaching the hook to the first end of the first elongated flexible member, and means for attaching the hook to the first end of the second elongated flexible member.

The retrievable boat mooring device is secured to the stationary horizontal member by casting the hook from the boat over the horizontal member, and is retrieved from the horizontal member by pulling on the second end of the second elongated flexible member, thereby drawing the hook over and away from the stationary horizontal member.

DETAILED DESCRIPTION OF THE INVENTION

Figure 1:
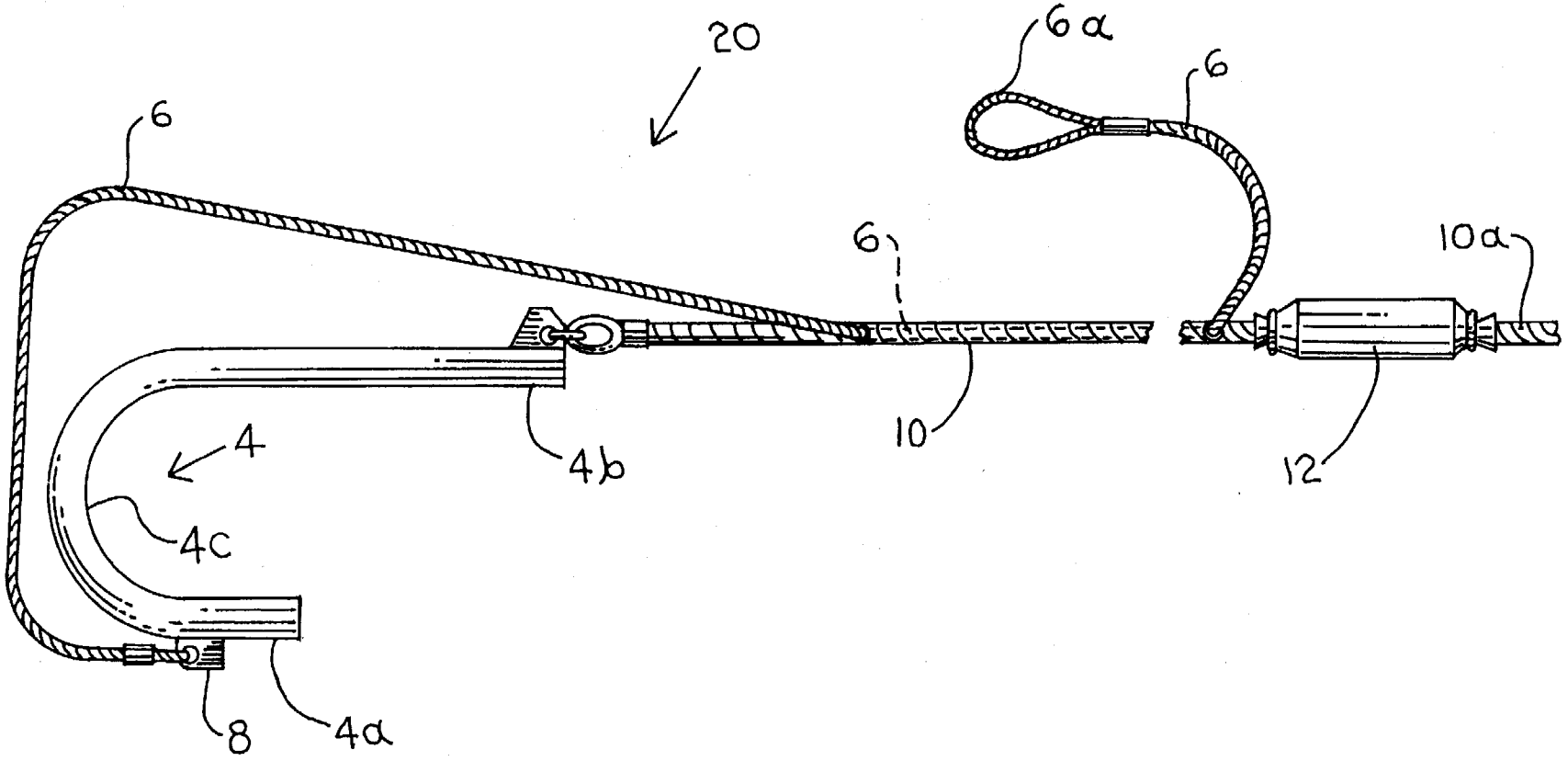
FIG. 1 is a schematic representation of a first embodiment of a retrievable boat mooring device, made in accordance with the principles of the present invention.

More specifically, reference is made to FIG. 1, in which is shown a first embodiment of a a retrievable boat mooring device, made in accordance with the principles of the present invention, and generally designated by the numeral 2.

The retrievable boat mooring device 2 comprises a hook 4, preferably made from aluminum pipe, to a first straight segment 4*a* of which is attached a preferably hot-dip galvanized wire-rope cable 6 by means of an eyelet 8. A tubular preferably Nylon rope 10 is attached to a second straight segment 4*b* of the hook 4. A semicircular segment 4*c* is disposed between and connects the first and second straight segments 4*a* and 4*b* to one another. A portion of the cable 6 is disposed within a portion of the Nylon rope 10. The free end of the cable 6 is external of the tubular Nylon rope 10, and terminates in a loop 6*a* for grasping and pulling the Nylon rope 6.

A shock-absorber 12 is beneficially attached to the other, free end of the rope 10, and a second length of the rope 10*a* is connected to the shock-absorber 12.

To fasten the retrievable boat mooring device 2 to a stationary structure, one has only to get within throwing range and simply toss the hook 4 over any type of horizontal brace, rail, pipe, or other elongated rigid member. After the hook has been thrown, one allows the boat to drift away from the structure and tie off at the desired distance. The hook 4 will automatically hold to the structure.

When one is ready to untie the boat, one simply eases the boat forward, grasps the cable loop 6*a*, and pulls. The hook 4 will roll off the horizontal support and fall into the water, where it can be easily retrieved.

Figure 2:
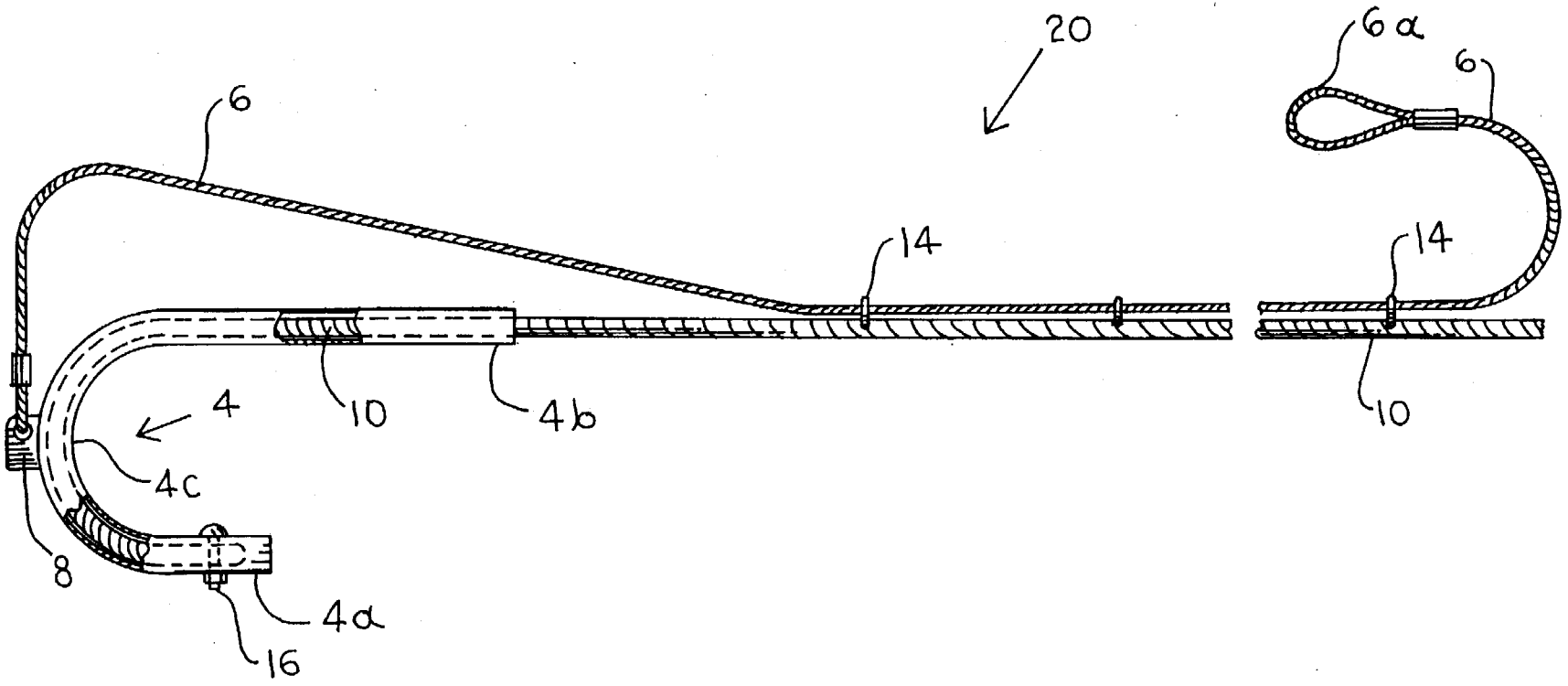
FIG. 2 is a schematic representation of a second embodiment of a retrievable boat mooring device, made in accordance with the principles of the present invention.

Reference is now made to FIG. 2, in which is shown a second embodiment of a retrievable boat mooring device, made in accordance with the principles of the present invention, and generally designated by the numeral 20. In this second embodiment the cable 6 is attached to the semicircular segment 4*c* of the hook 4, which is tubular, being made from pipe. The cable 6 is externally attached to the rope 10 by a plurality of S-hooks 14, a portion of the rope 10 is disposed within the tubular hook 4 and fastened thereto by a bolt 16, and the need for a shock-absorber 12 is eliminated by utilizing an elastic rope 10. This second embodiment 20 is the preferred embodiment of the present invention.

It will be clear from the foregoing description that the purpose and advantage of the present invention is to secure a boat to an off-shore oil platform or any other similar structure without having to get dangerously close thereto. The invention also allows one to untie the boat from the structure without having to get dangerously close to the structure.

The size and shape of the hook 4 are critical to the the book's ability to hook onto a rail, brace, or virtually any other horizontal structure every time, and to remain hooked until it is desired to unhook it. Here there is a marked contrast with the prior-art shepherd's hook, referred to and described in the background section of this application. The shepherd's hook has first and second straight members which diverge from one another, thereby making it possible for the hook to slip off the horizontal member to which it is being secured. In the hook 4 of the present invention, however, the first and second straight segments 4*a* and 4*b* are parallel to one another, thereby retaining the hook 4 securely on the horizontal member.

After the hook 4 is thrown over a brace or similar structure, the boat is allowed to drift away from the structure, with the free end of the rope 10 tied off to the boat. The rope 10 is secured to the longer, second straight segment 4*b* of the hook 4 thereby pulling the second straight segment 4*b* up and over the brace as the boat drifts backward. When the second, longer straight Segment 4*b* is pulled over the brace, the semicircular segment 4*c*, together with the shorter, first staight segment 4*a* attached thereto, automatically points downward, because of the greater weight of the second, longer straight segment 4*b*, which acts as a lever arm acted upon by gravity, thereby allowing the hook 4 to engage the brace and remain secured thereto indefinitely.

Retrieving the hook 4 from the structure is equally simple and easy. The retrieving cable 6 is fastened to to first, shorter straight segment 4*a* of the hook 4, and follows the hook 4 around the brace, runs into the tubular Nylon rope 10 for approximately fifteen feet, and terminates in a loop handle 6*a* outside of the rope 10. When the cable loop 6*a* is pulled, the shorter, first straight segment 4*a* of the hook 4 is pulled over, off of, and away from the structure, whence the hook 4 can be retrieved.

The throat, herein defined as the distance between the first and second straight segments 4*a* and 4*b*, is from about fourteen to about sixteen inches wide, which is sufficient clearance for the hook 4 to pass and hook over almost any brace, rail, or pipe found offshore.

The length of the first straight segment 4*a* is from about ten to about fourteen inches, the length of the second straight segment 4*b* is from about twenty-six to about thirty-four inches, and the semicircumferential length of the semicircular segment 4*c* is from about twenty to about thirty inches. These lengths are important, because they allow the hook 4 to be light enough to be thrown from a boat, and at the same time provide sufficient length to ensure that the hook 4 does not slip off the horizontal member to which it is temporarily attached.

The size, geometry, and dimensions of the hook 4 are thus crucial for enabling a person to moor his or her boat to an offshore oil platform without putting himself, herself, or the boat in danger by coming too close for safety to the platform. This is the primary objective of the present invention, and solves the problem defined by the inability of prior-art devices to enable a person to keep a safe distance from such a platform when mooring a boat thereto.

We claim:

1. A method for reversibly securing a boat to a stationary elongated rigid horizontal member on an off-shore oil platform, the method comprising the steps of:

(a) providing a retrievable boat mooring device comprising (b) a rigid member including a first straight segment having first and second ends, a second straight segment having first and second ends, and a curved segment disposed between and connecting the first and second straight segments to one another; the first and second straight segments being parallel to one another, the first end of the first straight segment being free, the second end of the first straight segment being connected to a first end of the curved segment, the first end of the second straight segment being free, the second end of the second straight segment being connected to a second end of the curved segment;

(c) a first elongated flexible member having first and second ends;

(d) a second elongated flexible member having first and second ends, the second elongated flexible member being attached to the first elongated flexible member;

(e) means for attaching the rigid member to the first end of the first elongated flexible member; and (f) means for attaching the rigid member to the first end of the second elongated flexible member;

the second elongated flexible member having a first segment external of the first elongated flexible member and terminating in the first end of the second elongated flexible member, a second segment external of the first elongated flexible member and terminating in the second end of the second elongated flexible, member, and a third segment disposed within the first elongated member and connecting the first and second segments to one another;

(g) securing the retrievable boat mooring device to the stationary horizontal member by casting the rigid member from the boat over the horizontal member; and (h) retrieving the rigid member from the horizontal member by pulling on the second end of the second elongated flexible member, thereby drawing the hook over and away from the stationary horizontal member.

2. A retrievable boat mooring device for reversible attachment to a stationary elongated rigid horizontal member on an off-shore oil platform, the retrievable mooring device comprising:

(a) a rigid member including a first straight segment having first and second ends, a second straight segment having first and second ends, and a curved segment disposed between and connecting the first and second straight segments to one another; the first and second straight segments being parallel to one another, the first end of the first straight segment being free, the second end of the first straight segment being connected to a first end of the curved segment, the first end of the second straight segment being free, the second end of the second straight segment being connected to a second end of the curved segment;

(b) a first elongated flexible member having first and second ends;

(c) a second elongated flexible member having first and second ends, the second elongated flexible member being attached to the first elongated member;

(d) means for attaching the rigid member to the first end of the first elongated flexible member; and (e) means for attaching the rigid member to the first end of the second elongated flexible member;

the second elongated flexible member having a first segment external of the first elongated flexible member and terminating in the first end of the second elongated flexible member, a second segment external of the first elongated flexible member and terminating in the second end of the second elongated flexible member, and a third segment disposed within the first elongated member and connecting the first and second segments to one another.

3. A retrievable boat mooring device for a reversible attachment to a stationary elongated rigid member of an off-shore oil platform, the retrievable mooring device comprising:

(a) a rigid member including a first straight segment having first and second ends, a second straight segment having first and second ends, and a curved segment disposed between and connecting the first and second straight segments to one another; the first and second straight segments being parallel to one another, the first end of the first straight segment being free, the second end of the first straight segment being connected to a first end of the curved segment, the first end of the second straight segment being free, the second end of the second straight segment being connected to a second end of the curved segment;

(b) a first elongated flexible member having first and second ends;

(c) a second elongated flexible member having first and second ends, the second elongated flexible member being attached to the first elongated member;

(d) means for attaching the rigid member to the first end of the first elongated flexible member; and (e) means for attaching the rigid member to the first end of the second elongated flexible member;

the rigid member being tubular, the second elongated flexible member being externally attached to the first elongated flexible member, a portion of the first elongated flexible member being disposed within the rigid tubular member and fastened therto, and the second elongated flexible member being externally attached to the curved segment of the rigid tubular member.

4. A method for reversibly securing a boat to a stationary elongated rigid horizontal member on an off-shore oil platform, the method comprising the steps of:

(a) providing a retrievable boat mooring device comprising (b) a rigid member including a first straight segment having first and second ends, a second straight segment having first and second ends, and a curved segment disposed between and connecting the first and second straight segments to one another; the first and second straight segments being parallel to one another, the first end of the first straight segment being free, the second end of the first straight segment being connected to a first end of the curved segment, the first end of the second straight segment being free, the second end of the second straight segment being connected to a second end of the curved segment;

(c) a first elongated flexible member having first and second ends;

(d) a second elongated flexible member having first and second ends, the second elongated flexible member being attached to the first elongated member;

(e) means for attaching the rigid member to the first end of the first elongated flexible member; and (f) means for attaching the rigid member to the first end of the second elongated flexible member;

the rigid member being tubular, the second elongated flexible member being externally attached to the first elongated flexible member, a portion of the first elongated flexible member being disposed within the rigid tubular member and fastened therto, and the second elongated flexible member being externally attached to the curved segment of the rigid tubular member;

(g) securing the retrievable boat mooring device to the stationary horizontal member by casting the rigid member from the boat over the horizontal member; and (h) retrieving the rigid member from the horizontal member by pulling on the second end of the second elongated flexible member, thereby drawing the rigid member over and away from the stationary horizontal member.

* * * * *